US008888440B2

(12) United States Patent
Tomita et al.

(10) Patent No.: US 8,888,440 B2
(45) Date of Patent: Nov. 18, 2014

(54) COMPRESSOR OF EXHAUST GAS TURBOCHARGER

(75) Inventors: Isao Tomita, Tokyo (JP); Seiichi Ibaraki, Tokyo (JP); Yasuaki Jinnai, Tokyo (JP); Masaki Tojo, Tokyo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 382 days.

(21) Appl. No.: 13/383,951

(22) PCT Filed: Aug. 10, 2010

(86) PCT No.: PCT/JP2010/063582

§ 371 (c)(1),
(2), (4) Date: Jan. 30, 2012

(87) PCT Pub. No.: WO2011/045975

PCT Pub. Date: Apr. 21, 2011

(65) Prior Publication Data

US 2012/0121400 A1 May 17, 2012

(30) Foreign Application Priority Data

Oct. 16, 2009 (JP) ..... 2009-239690

(51) Int. Cl.

| | |
|---|---|
| ***F04D 29/66*** | (2006.01) |
| ***F04D 29/42*** | (2006.01) |
| ***F04D 29/68*** | (2006.01) |
| ***F04D 27/02*** | (2006.01) |

(52) U.S. Cl.

CPC ..... *F04D 29/4213* (2013.01); *F04D 29/685* (2013.01); *F04D 29/682* (2013.01); *F04D 27/023* (2013.01); *F04D 27/0238* (2013.01); *F04D 29/684* (2013.01); *F04D 29/681* (2013.01); *Y10S 415/914* (2013.01)

USPC ..... 415/57.1; 415/58.4; 415/914

(58) Field of Classification Search

CPC . F04D 29/4213; F04D 29/441; F04D 27/023; F04D 27/0238; F04D 27/0215; F04D 27/0207; F04D 29/681; F04D 29/682; F04D 29/684; F04D 29/685

USPC ..... 415/57.1–57.4, 58.1–58.5, 58.7, 914

See application file for complete search history.

(56) References Cited

U.S. PATENT DOCUMENTS

| | | | | |
|---|---|---|---|---|
| 4,630,993 | A * | 12/1986 | Jensen | 415/58.7 |
| 5,246,335 | A * | 9/1993 | Mitsubori et al. | 415/58.3 |
| 5,333,990 | A * | 8/1994 | Foerster et al. | 415/58.4 |

FOREIGN PATENT DOCUMENTS

| | | | |
|---|---|---|---|
| CN | 101542129 | A | 9/2009 |
| JP | 63-183204 | A | 7/1988 |

(Continued)

OTHER PUBLICATIONS

Chinese Office Action dated Sep. 29, 2013 for Chinese Application No. 201080021643.4 with English translation.

JP Office Action issued Jul. 4, 2013 for corresponding Japanese Application No. 2009-239690 and an English Translation.

(Continued)

*Primary Examiner* — Christopher Verdier

(74) *Attorney, Agent, or Firm* — Birch, Stewart, Kolasch & Birch, LLP

(57) ABSTRACT

A compressor of an exhaust gas turbocharger has a compressor housing of a divided type that forms an inlet slit, an outlet slit and a recirculation passage at the same time when the compressor housing is assembled. In the compressor of the exhaust gas turbocharger, mating surfaces of compressor housing members 9*a* and 9*b* are formed in the neighborhood of the inlet part of the impeller 5 in the compressor housing 9 that is divided into the compressor housing members 9*a* and 9*b* in the direction of the rotation axis of the impeller; and, a space forming the recirculation passage 29, an inlet slit 25 and an outlet slit 27 are formed between the mating compressor housing members 9*a* and 9*b*.

5 Claims, 8 Drawing Sheets

(56) References Cited

FOREIGN PATENT DOCUMENTS

| | | | |
|---|---|---|---|
| JP | 5-340395 | A | 12/1993 |
| JP | 2510350 | Y2 | 9/1996 |
| JP | 2000-64848 | A | 2/2000 |
| JP | 2003-74360 | A | 3/2003 |
| JP | 2004-144029 | A | 5/2004 |
| JP | 2005-188337 | A | 7/2005 |
| JP | 2006-342682 | A | 12/2006 |
| JP | 2007-127108 | A | 5/2007 |
| JP | 2007-127109 | A | 5/2007 |

OTHER PUBLICATIONS

Decision to Grant a Patent effective Jan. 8, 2014 issued in corresponding Japanese Application No. JP 2009-239690 with an English translation.

Korean Notice of Allowance issued Oct. 30, 2013 for corresponding Korean Application No. 10-2011-7031360 with English Translation.

Chinese Notice of Allowance for Chinese Application No. 201080021643.4, dated Sep. 26, 2014, along with an English translation thereof.

* cited by examiner

PRIOR ART

PRIOR ART

COMPRESSOR OF EXHAUST GAS TURBOCHARGER

BACKGROUND OF THE INVENTION

1. Field of the Invention

The present invention relates to a compressor that is used for an exhaust gas turbocharger of an engine, the compressor including, but not limited to: a recirculation passage connecting an inlet slit that is opened toward the air passage on the casing of the impeller to an outlet slit that is opened toward the compressor inlet air passage, wherein a part of the air flow through the impeller is taken in the recirculation passage through the inlet slit whereas the air taken into the recirculation passage flows toward the compressor inlet air passage.

2. Background of the Invention

The compressor of the turbocharger used for a vehicle has a performance characteristic as shown in FIG. 12, in which the vertical axis and the lateral axis denote the pressure ratio of the compressor and the fluid flow rate; in FIG. 12, along a line of a constant rotation speed $N_i$ (i=1, 2, . . . ), the smaller the flow rate, the higher the pressure ratio. Further, when the rotation speed $N_i$ is increased (for $N_i$, i=1, 2, . . . ), the pressure ratio is apt to increase.

Further, when the flow rate is increased, there appears a choking phenomenon where the flow rate can be no longer increased; on the other hand, when the flow rate is decreased, there appears a surging phenomenon where an irregular flow such as a backward flow of the working air occurs and the operation of the compressor becomes impossible. Thus, there is an operation zone in which the compressor can be operated between the surging limit on the smaller flow rate side and the choking limit on the greater flow rate side.

Further, the compressor of the turbocharger used for a vehicle has to be operated in a wide range regarding the flow rate; thus, it is required to enhance the operation zone of the compressor as wide as possible. Hence, it becomes necessary that the surging limit line L1 (cf. FIG. 12) on the smaller flow rate side be shifted toward the left side as far as possible, in order that the operation zone is enhanced, the shifted surging limit line being depicted as the line L2 (in FIG. 12).

An approach called a casing treatment is known as one of the manners by which the operation zone of the compressor is enhanced. According to the casing treatment, the casing of the compressor is provided with a groove or a circulation flow passage so that the air flow in the compressor is controlled. According to an example of the casing treatment approaches, in a case of the smaller air flow rate, a part of the air entering the inside of the compressor is recirculated so that the apparent flow rate is increased; thus, the surging can be hard to happen and the operation zone can be enhanced.

However, according to the approach as described above, it is necessary to machine the inner surface of the casing so as to form the recirculation passage for the return of the flow; thus, the production cost increase is incurred.

For instance, as shown in FIG. 13, an impeller 03 is fitted to the outer periphery of an end side of the rotor hub 01 whereas a turbine (not shown) is provided on another end side of the rotor hub; the rotor hub 01 and the impeller 03 are rotated around a rotation axis 05 by the turbine. Further, the impeller 03 is housed in a compressor housing 07; an air inlet passage 09 is formed on the air inlet side of the impeller 03; a diffuser 11 is provided on the air outlet side of the impeller 03; a scroll (a compressor outlet part) 13 is provided on the downstream side of the diffuser 11.

A recirculation passage 015 of an annular geometry is formed at the casing of the impeller 03 in the compressor housing 07; an inlet slit 017 is formed so that the inlet side of the recirculation passage 015 communicates with the air passage on the casing of the impeller; the outlet side of the recirculation passage 015 is opened toward the air inlet passage 09 so that the air entering the impeller is circulated to the air inlet side of the impeller 03.

Further, as shown in FIG. 13, in the configuration in which the outlet side of the recirculation passage 015 is opened toward the air inlet side of the impeller 03, the sound generated in the impeller is easily transmitted toward the upstream side of the impeller; thus, there may be a problem that the noise level becomes higher.

In order to control the noise, a noise insulation cover can be provided; however, providing a noise insulation cover brings another problem that the production cost is increased.

On the other hand, Patent Reference 1 (JP2007-127108) as well as Patent Reference 2 (JP2007-127109) discloses a technology in relation to the recirculation passage and the anti-noise measures.

In the disclosure of Patent Reference 1 as shown in FIG. 14, the compressor including a recirculation passage 028 connecting an inlet slit 021 that is opened toward the air passage on the casing of the impeller 020 to an outlet slit 026 that is opened toward an air inlet passage 024 of the compressor 022, wherein a part of the air flow through the impeller 020 is taken in the recirculation passage 028 through the inlet slit whereas the air taken into the recirculation passage streams toward the air inlet passage 024 through the outlet slit 026.

A recirculation passage forming member 032 is provided so as to form the recirculation passage 028 at the outer periphery of the air inlet passage 024 inside of the compressor housing 030; the recirculation passage forming member 032 is detachably attached to the outer periphery of the recirculation passage 028 of the air inlet passage 024 in the compressor housing 030; and, the recirculation passage 028 and the outlet slit 026 are formed by the inner recirculation-passage-side surface of the recirculation passage forming member 032 and the inner surface of the compressor housing 030.

Further, in the disclosure of Patent Reference 2 as shown in FIG. 15, the compressor including a recirculation passage 048 connecting an inlet slit 041 that is opened toward the air passage on the casing of the impeller 040 to an outlet slit 046 that is opened toward an air inlet passage 044 of the compressor 022, wherein a part of the air flow through the impeller 040 is taken in the recirculation passage 048 through the inlet slit whereas the air taken into the recirculation passage streams toward the air inlet passage 044 through the outlet slit 046.

Thereby, the outlet slit 046 is formed so that the direction of the outlet slit 046 and the radial direction of the impeller 040 form a predetermined acute angle $\alpha$ (FIG. 15); namely, the center line regarding the air flow out of the outlet slit 046 is directed toward the impeller 040. In addition, the passage area of the outlet slit 046 is made greater than the passage area of the inlet slit 041. Further, the recirculation passage forming member 050 is provided so as to form the recirculation passage 048 at the outer periphery of the air inlet passage 044 inside of the compressor housing 052; the outer periphery surface of the recirculation passage forming member 050 and the inner surface of the compressor housing 052 form the recirculation passage 048 as well as the inlet slit 041.

REFERENCES

Patent References

Patent Reference 1: JP2007-127108
Patent Reference 2: JP2007-127109

SUMMARY OF THE INVENTION

Subjects to be Solved

According to the disclosed technology of Patent Reference 1, the recirculation passage forming member 032 is detachably provided at the outer periphery of the air inlet passage 024 inside of the compressor housing 030; and, the outlet slit 026 is formed between the recirculation passage forming member 032 and the inner surface of the compressor housing 030. Further, according to the disclosed technology of Patent Reference 2, the recirculation passage forming member 050 is detachably provided at the outer periphery of the air inlet passage 044 inside of the compressor housing 052; and, the inlet slit 041 is formed between the recirculation passage forming member 050 and the inner surface of the compressor housing 052.

Hence, one of the inlet slit and the outlet slit is to be provided at a place where the compressor housing and the recirculation passage forming member face each other; the remaining inlet slit or outlet slit is to be provided by a machining process, in addition to the facing part. Thus, in the technologies of Patent Reference 1 and Patent Reference 2, there are problems that the machining work becomes complicated and the production cost is increased.

Further, according to the disclosed technologies, the machining work regarding the inlet slit has to be performed separately from the machining work regarding the outlet slit; accordingly, it becomes difficult to simplify the structure around the inlet slit, the outlet slit and the recirculation passage; further, it is also difficult to easily adjust the structure or the geometry regarding the inlet slit, the outlet slit and the recirculation passage at the same time, the structure or the geometry being suitable for the improvement of the compressor performance.

In view of the difficulties as described above, the present invention aims at providing a compressor of an exhaust gas turbocharger whereby the structure of the inlet slit, the outlet slit and the recirculation passage can be adjustably arranged at the same time when the compressor housing of a divided type is assembled or disassembled;

the man-hours needed for assembling the compressor as well as the production cost can be reduced;

the structure of the inlet slit, the outlet slit and the recirculation passage can be compact;

the structure or the geometry regarding the inlet slit, the outlet slit and the recirculation passage can be easily adjusted or modified, the structure or the geometry being suitable for the improvement of the compressor performance; and, the noises generated in the impeller can be reduced without providing a noise insulation cover.

Means to Solve the Subjects

In order to reach the goal of the present invention, this specification discloses a compressor of an exhaust gas turbocharger, the compressor including a recirculation passage connecting an inlet slit which is opened toward an air passage on the casing of the impeller to an outlet slit that is opened toward the compressor inlet air passage formed in the compressor housing, wherein a part of an air flow through the impeller is taken in the recirculation passage through the inlet slit, and the air taken in the recirculation passage flows toward the compressor inlet air passage, wherein a mating surface of the compressor housing which is divided into compressor housing members in the direction of the rotation axis of the impeller is formed in the neighborhood of an inlet part of the impeller, and a space forming the recirculation passage, the inlet slit and the outlet slit are formed between the mating compressor housing members.

According to the above-described invention, a mating surface of the compressor housing which is divided into compressor housing members in the direction of the rotation axis of the impeller is formed in the neighborhood of an inlet part of the impeller. Hence, combining the divided compressor housing members can form the space forming the recirculation passage, the inlet slit and the outlet slit. Accordingly, the additional machining to form the inlet slit and the outlet slit can be dispensed with; and, the reduction of production man-hours as well as production cost can be achieved.

Further, the inlet slit, the outlet slit and the recirculation passage are formed around the mating surface of the compressor housing members; thus, the structure regarding the inlet slit, the outlet slit and the recirculation passage can be compactly arranged; and, the compressor housing provided with the recirculation passage can be further compact and light-weight, especially in a case where the compressor housing is made by use of resin material.

Further, the inlet slit, the outlet slit and the recirculation passage are formed around the mating surface of the compressor housing members; thus, the structure and geometry of the inlet slit, the outlet slit and the recirculation passage can be easily adjusted so that the structure and geometry is suitable for enhancing the compressor performance.

Further, the recirculation passage is not opened toward the air inlet side of the impeller; thus, the noises are difficult to be transmitted the upstream side of the air flow, and the noises generated in the impeller can be reduced without a noise insulation cover.

A preferable embodiment of the above-described invention is the compressor of the exhaust gas turbocharger, the mating surface including, but not limited to, comb shaped mating surfaces respectively formed on one of the compressor housing members and the other compressor housing member, wherein a convex part e.g., (formed of a single tooth) of one of the comb shaped mating surfaces is fit into a concave part e.g., (formed between two adjacent teeth) of the other comb shaped mating surface so that a space formed between a tip part of the convex part and a bottom part of the concave forms the inlet slit and the outlet slit.

As described above, a convex part of one of the comb shaped mating surfaces is fit into a concave part of the other comb shaped mating surface so that a space formed between a tip part of the convex part and a bottom part of the concave forms the inlet slit and the outlet slit. Hence, at the same time when the mating surface is arranged, the inlet slit and the outlet slit can be simply and surely formed.

Another preferable embodiment of the above-described invention is the compressor of the exhaust gas turbocharger, wherein a side wall of the convex part of the comb shaped mating surface is inclined along the same direction as the rotation direction of the impeller, the side wall forming the inlet slit.

As described above, the inlet slit is inclined along the same direction as the rotation direction of the impeller; thus, the swirl flow in the impeller apt to streams into the recirculation passage. In this way, the recirculation flow rate can be increased; and, the apparent flow rate of the air flow into the impeller can be increased. Accordingly, the surging phenomenon can be constrained.

Another preferable embodiment of the above-described invention is the compressor of the exhaust gas turbocharger, wherein a side wall of the convex part of the comb shaped mating surface is inclined along the reverse direction of the rotation direction of the impeller, the side wall forming the outlet slit.

As described above, the outlet slit is inclined along the reverse direction of the impeller rotation direction; thus, the direction of the air flow toward the impeller changes from the X-arrow direction to the Y-arrow direction as illustratively shown in FIG. 6; and, the air flow effectively hits the impeller. In this way, the recirculation flow rate can be increased; and, the apparent air flow rate into the impeller can be increased. Accordingly, the surging phenomenon can be constrained.

Another preferable embodiment of the above-described invention is the compressor of the exhaust gas turbocharger, wherein the tip part and the bottom part which form the inlet slit are inclined along the direction of the rotation axis of the impeller so that the main flow through the air passage is difficult to flow into the inlet slit and the backward flow easily streams into the inlet slit.

The effect of the above-described configuration is hereby explained. As shown in FIG. 7, the inlet slit that is inclined along the direction of the rotation axis of the impeller so that the main air flow through the air passage is difficult to stream into the inlet slit and the backward flow is easy to stream into the inlet slit; on the other hand, a backward flow toward the upstream side is apt to occur at the leading edge side (the inlet side) of the impeller under the low load operation condition in which the air flow rate is small; further, the backward flow is difficult to occur under a normal operation condition in which the air flow rate is normal; thus, the air recirculation is promoted only under the low load operation condition in which the air flow rate is small and the backward flow is apt to occur, whereas the air recirculation is constrained under the normal operation condition. In this way, under the normal operation condition, the air recirculation can be constrained and the performance deterioration can be prevented; and, under the low load operation condition, the air recirculation can be positively promoted and the occurrence of the surging can be prevented.

Another preferable embodiment of the above-described invention is the compressor of the exhaust gas turbocharger, wherein partition walls dividing the recirculation passage in the hoop direction are set up along the rotation axis direction of the impeller at the outer periphery surface of the comb shaped convex part and the comb shaped concave part outward; and the partition walls form an area section provided with the inlet slit and the outlet slit.

The effect of the above-described configuration is hereby explained. The velocity of the air flow into the recirculation passage via the inlet slit has a velocity component along the direction of the swirl flow in the impeller; in the area section formed by the partition walls, the velocity component along the direction of the swirl flow is lost. Thus, when the air flow streams through the outlet slit, the velocity of the air flow does not include the velocity component along the direction of the swirl flow, and the air flow without the velocity component streams through the outlet slit streams into the main flow toward the impeller so as to effectively hit the impeller and increase the collision load of the air flow on the impeller. Further, the pressure of the air at the suction opening around the leading edge of the impeller increases so that the air flow rate of the recirculation flow can be increased. As is the case with the later explanation regarding FIG. 6, the smaller the velocity component along the rotation direction of the impeller, the greater the recirculation air flow rate.

Further, the air flow whose velocity component along the rotation direction is lost in the area sections formed by the partition walls is easily apt to form an air flow along the inclination of the outlet slit; thus, the air flow whose flow direction is reverse against the rotation direction of the impeller can be easily formed. In this way, the surging phenomenon can be effectively constrained.

Another preferable embodiment of the above-described invention is the compressor of the exhaust gas turbocharger, wherein an intermediate compressor housing formed in an annular shape is attached between the mating compressor housing members, the inner periphery surface side of the intermediate compressor housing faces the air passage on the casing of the impeller, the recirculation passage is formed on the outer periphery surface side of the intermediate compressor housing, and the inlet slit and the outlet slit are respectively formed along the hoop direction on the both end parts.

As described above, the intermediate compressor housing is provided. The inlet slit is formed on an end side of the body that configures the intermediate compressor housing, whereas the outlet slit is formed on another end side of the body. Hence, the opening area of the inlet slit as well as the outlet slit can be freely set at a larger area level in comparison with the case of the mating surface of the comb shape protrusions. Thus, the recirculation flow rate can be increased, and the surging phenomenon can be further effectively constrained.

Further, in relation to the modification of the opening area regarding the inlet slit and the outlet slit as well as the modification of the opening direction, the configuration and the geometry can be easily arranged by modifying the intermediate compressor housing as a basic member to modify the structure.

Another preferable embodiment of the above-described invention is the compressor of the exhaust gas turbocharger, wherein a plate member dividing the recirculation passage in the hoop direction is set up along the rotation axis direction of the impeller on the outer periphery surface outward side of the intermediate compressor housing, and both ends of the plate member are fit into and fixed to the space between one of the compressor housing members and the other compressor housing member.

As described above, the plate members dividing the recirculation passage in the hoop direction are arranged outward on the outer periphery surface side of the intermediate compressor housing; thus, in an area section formed by the plate members, the velocity component of the air flow formed by the impeller rotation is lost as is the case with the area section formed by the partition walls; thus, the air flow out of the outlet slit effectively hits the impeller and the recirculation flow rate can be increased.

Further, the plate member is fit into and fixed to the space between one of the compressor housing members and the other compression housing member; thus, via the fixing of the plate member, the intermediate compressor housing can be surely positioned and fixed between the one compression housing member and the other compression housing member.

Effects of the Invention

According to the above-described invention, a mating surface of the compressor housing which is divided into compressor housing members in the direction of the rotation axis of the impeller is formed in the neighborhood of an inlet part of the impeller. Hence, combining the divided compressor housing members can form the space forming the recirculation passage, the inlet slit and the outlet slit. Accordingly, the additional machining to form the inlet slit and the outlet slit can be dispensed with; and, the reduction of production manhours as well as production cost can be achieved.

Further, the inlet slit, the outlet slit and the recirculation passage are formed around the mating surface of the compressor housing members; thus, the structure regarding the inlet slit, the outlet slit and the recirculation passage can be compactly arranged; and, the compressor housing provided with the recirculation passage can be further compact and light-weight.

Further, the inlet slit, the outlet slit and the recirculation passage are formed around the mating surface of the compressor housing members; thus, the structure and geometry of the inlet slit, the outlet slit and the recirculation passage can be easily adjusted so that the structure and geometry is suitable for enhancing the compressor performance.

Further, the recirculation passage is not opened toward the air inlet side of the impeller; thus, the noises are difficult to be transmitted the upstream side of the air flow, and the noises generated in the impeller can be reduced without a noise insulation cover.

BRIEF DESCRIPTION OF THE DRAWINGS

FIG. 5(*a*) is a drawing corresponding to FIG. 4;

FIG. 5(*b*) is a drawing explaining the major parts appearing in the B-B cross section of FIG. 1;

FIG. 5(*c*) is a drawing explaining the major parts appearing in the C-C cross section of FIG. 1;

FIG. 10(*a*) shows a cross-section depicting the assembled state regarding the major configuration of the compressor housing members that form the outer periphery of the impeller;

FIG. 10(*b*) shows a bird view regarding a detail of a third compressor housing member;

DETAILED DESCRIPTION OF THE INVENTION

Hereafter, the present invention will be described in detail with reference to the modes or embodiments shown in the figures. However, the dimensions, materials, shape, the relative placement and so on of a component described in these modes or embodiments shall not be construed as limiting the scope of the invention thereto, unless especially specific mention is made.

(First Mode)

Figure 1:
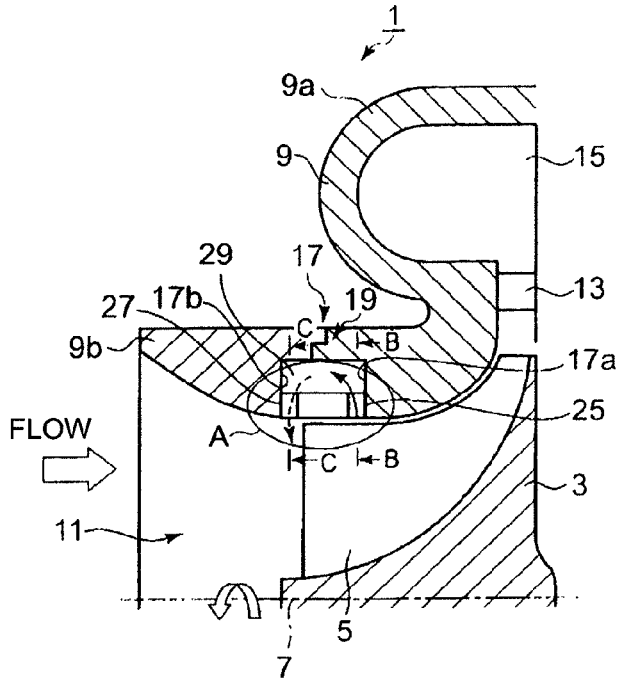
FIG. 1 shows the major parts of an exhaust gas turbocharger compressor according to a first mode of the present invention, in a cross-section that includes the rotation axis of the compressor, the major parts being depicted in an upper half plane of the cross-section divided by the rotation axis.

FIG. 1 shows the major parts of an exhaust gas turbocharger compressor according to a first mode of the present invention, in a cross-section that includes the rotation axis of the compressor, the major parts being depicted in an upper half plane of the cross-section divided by the rotation axis.

As shown in FIG. 1, the compressor 1 are configured so that:

an impeller 5 is fitted to the outer periphery of an end side of the rotor hub 3 whereas a turbine (not shown) is provided on another end side of the rotor hub 3; and, the rotor hub 3 and the impeller 5 is rotated around a rotation axis 7 by the turbine.

Further, the impeller 5 is housed in a compressor housing 9;

an air inlet passage 11 is formed on the air inlet side of the impeller 5; a diffuser 13 with or without a blade is provided on the air outlet side of the impeller 5;

a scroll 15 is provided on the downstream side of the diffuser 13.

A mating surface 17 where the compressor housing members configuring the compressor housing of a divided type come in contact with each other is formed in the neighborhood of the air inlet part of the impeller 5 in the compressor housing 9, the compressor housing 9 being divided into two compressor housing members that are located at the front side and the rear side along the rotation axis 7. In other words, the compressor housing 9 is configured with a first compressor housing member 9*a* on the base body side of the compressor housing and a second compressor housing member 9*b* on the front end side of the compressor housing 9. And, on the casing of the mating surface, a fitting structure 19 via which two compressor housing members 9*a* and 9*b* are fastened to each other by means of a fastening means (not shown) such as bolts, welding, adhesives and so on is provided. Further, the fitting structure 19 is used for determining the relative position regarding the first and second compressor housing members 9*a* and 9*b*.

Figure 2:
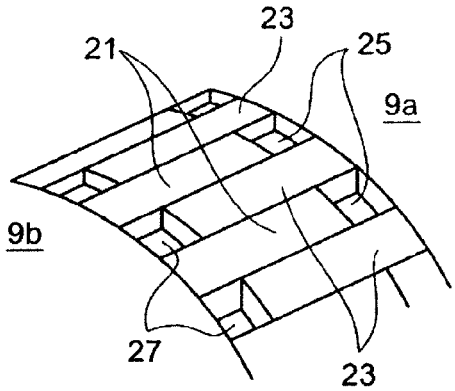
FIG. 2 shows a bird view regarding an enlargement of the part A in FIG. 1 so as to explain the inside of the part A.
Figure 4:
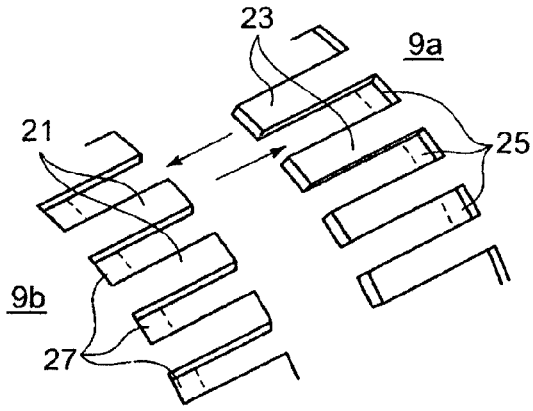
FIG. 4 explains how a comb-shaped part is fitted into another comb-shaped part in response to the part A in FIG. 1, the comb meshing with the other comb.

Further, as shown in FIGS. 2 and 4, on the impeller 5 side of the mating surface part 17, in a hoop direction, a plurality of protrusions 21 (from 10 to 20 in number) is provided on the side of the second compressor housing member 9*b* toward the side of the first compressor housing member 9*a*, the protrusions being arranged in parallel side by side in the hoop direction; in the similar way, a plurality of protrusions 23 (from 10 to 20 in number) is provided on the side of the first compressor housing member 9*a* toward the side of the second compressor housing member 9*b*, the protrusions being arranged in parallel side by side in the hoop direction. And, the protrusions 23 of a first comb and the protrusions 21 of a second comb mesh so that a protrusion (a convex part formed by each protrusion 23) on the first comb side is air-tightly engaged into a concave defined between the adjacent protrusions 21 on the second comb side; similarly, a protrusion on the second comb side is air-tightly engaged into a gap between the adjacent protrusions on the first comb side.

Further, before the tip of the protrusion 21 as well as the protrusion 23 of the comb shape reaches the bottom of the corresponding concave part, the fitting condition or the relative position regarding the first compressor housing part 9*a* and the second compressor housing part 9*b* is determined. In this way, the length regarding the protrusion 21 and 23 of the comb shape (or the depth regarding the concave part) is determined. As a result, under the condition that the compressor housing members are fitted to each other, a space is formed between the tip of the protrusion 21 as well as the protrusion 23 of the comb shape and the bottom of the corresponding concave part. Thus, the inlet slit 25 is formed on the downstream side of the leading edge (air inlet) of the impeller 5, whereas the outlet slit 27 is formed on the upstream side of the leading edge of the impeller 5.

Further, a recirculation passage 29 of an annular space is formed between the outer periphery surface configured by the comb protrusions 21 and 23 and the inner surface of the fitting structure 19, as well as, between a mating surface 17*a* on the side of the first compressor housing member 9*a* and a mating surface 17*b* on the side of the second housing member 9*b*.

In this way, the moment when the first compressor housing member 9*a* and the second compressor housing member 9*b* are assembled, the recirculation passage 29, the inlet slit 25 and the outlet slit 27 are formed between the mating surface 17*a* on the side of the first compressor housing member 9*a* and the mating surface 17*b* on the side of the second housing member 9*b*.

According to the configuration of the first mode as described above, when the impeller 5 rotates via a rotor hub 3 that is rotationally driven by a turbine (not shown), the impeller 5 pressurizes the air inhaled through the air inlet passage 11, and pressurized air is delivered from the compressor 1 to an engine (not shown) through the diffuser 13 and the scroll 15.

Figure 3:
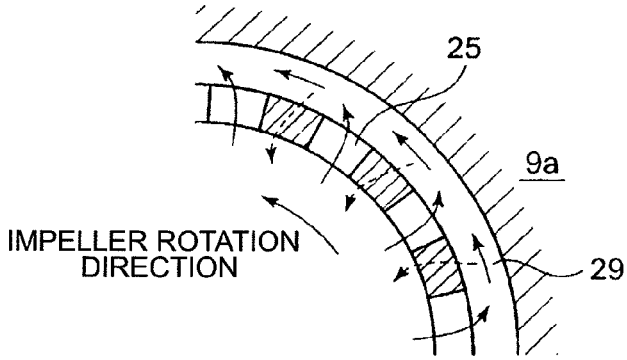
FIG. 3 shows the major configuration of a B-B cross-section of FIG. 1.

A part of the air flow along the casing of the impeller forms a recirculation air flow by the rotation movement of the impeller 5, so as to stream along the arrow direction as depicted in FIG. 3; the part of the air enters the recirculation passage 29 through the inlet slit 25 so as to form a swirl flow in the recirculation passage 29 in response to the rotation direction of the impeller 5. And, the recirculation flow air reaching the outlet slit 27 streams out toward the leading edge part of the impeller 5 through the outlet slit 27 as shown by the dotted arrow lines in FIGS. 1 and 3.

Figure 12:
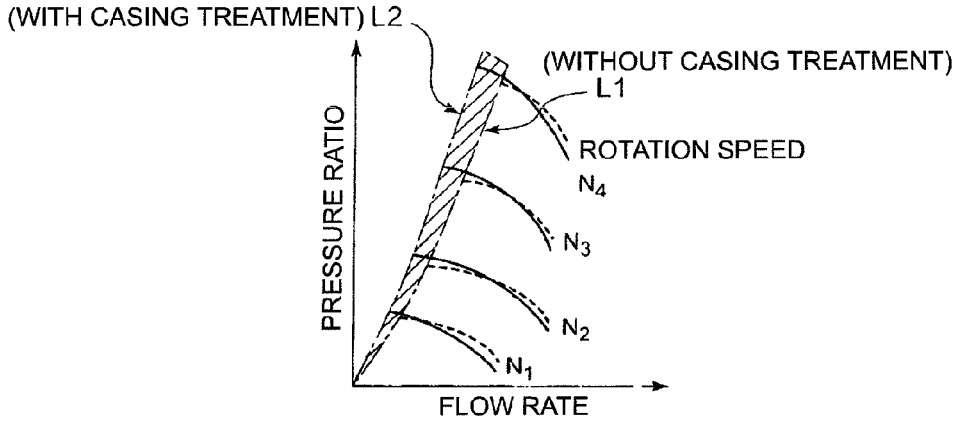
FIG. 12 explains the characteristic of the compressor of the turbocharger; and each of FIGS. 13 to 15 explains a conventional technology.
Figure 13:
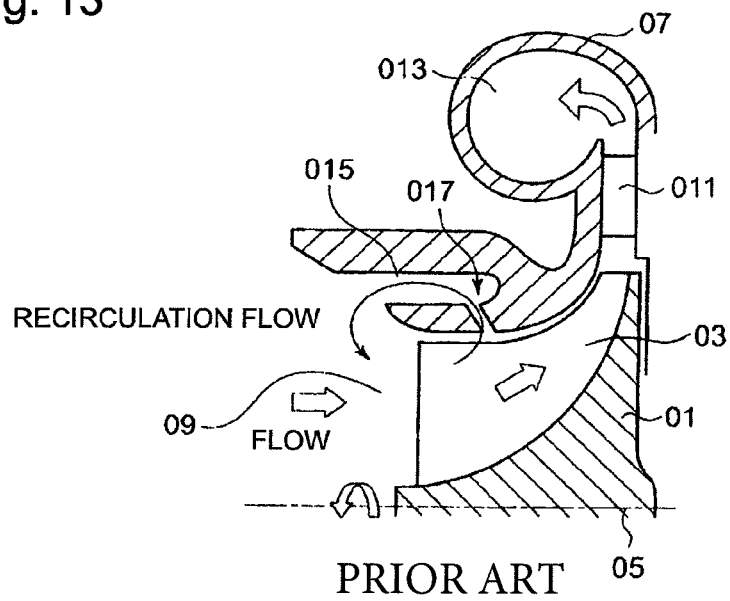
Figure 14:
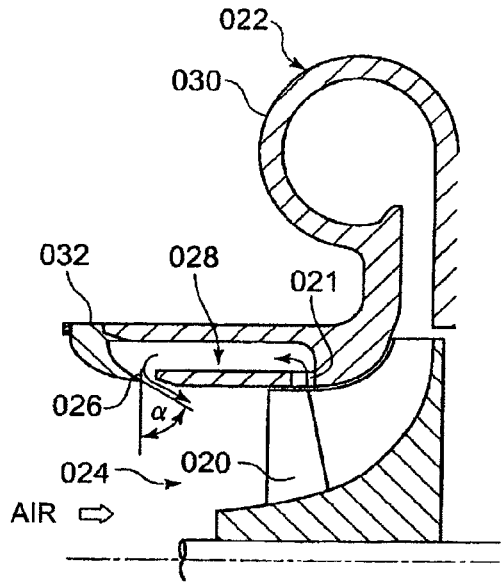
PRIOR ART Fig. 14
Figure 15:
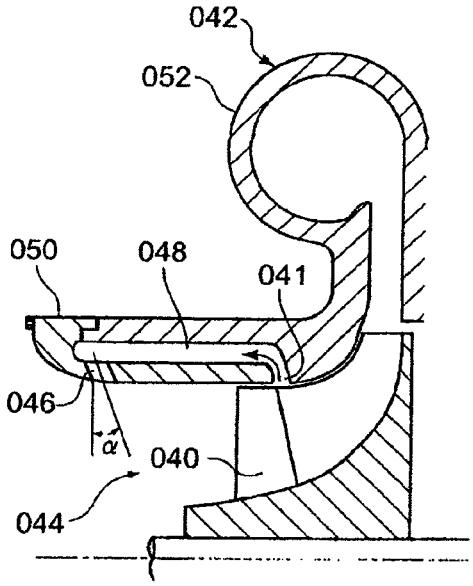

According to the circulation of the recirculation air flow, the apparent air flow rate of the air flow into the area in the neighborhood of the leading edge part in the impeller 5 increases. Thus, the operation line of the compressor 7 is shifted and the operation zone is enhanced so that an operation line L1 in a case where the recirculation flow air is not formed (i.e. the case without casing treatment) moves toward an operation line L2 in a case where the recirculation passage 29 is provided (i.e. the case with casing treatment), as shown in FIG. 12. Thus, even in the compressor operation zone where the air flow rate is at a small level as is the case with the engine low load condition, a stable operation without surging can be achieved.

According to the first mode as described, in the neighborhood of the air inlet part of the impeller 5 in the compressor housing 9, the mating surface (part) 17 is formed between the first compressor housing member 9*a* and the second compressor housing member 9*b*; on the side of the mating surface 17*a* of the first compressor housing member 9*a*, the protrusions 23 of a comb shape are formed; on the side of the mating surface 17*b* of the second compressor housing member 9*b*, the protrusions 21 of a comb shape are formed; the protrusions 21 of a comb shape and the protrusions 23 of a comb shape are meshed with each other so that the space configuring the recirculation passage 29, the inlet slit 25 and the outlet slit 27 are simply and surely formed at the same time. Thus, the additional machining for forming the inlet slit 25 and the outlet slit 27 can be dispensed with, and the production man-hours and the production cost can be reduced.

Further, the inlet slit 25, the outlet slit 27 and the recirculation passage 29 are formed around the mating surface (part) 17 of the compressor housing members. Thus, the configuration regarding the inlet slit, the outlet slit and the recirculation passage is compactly arranged; and, the compressor housing with the recirculation passage can be compact and light-weight. Further compactness and light-weight can be achieved, especially in a case where the compressor housing is made by use of resin material.

Further, the inlet slit 25, the outlet slit 27 and the recirculation passage 29 are formed around the mating surface (part) 17 of the compressor housing members. Thus, the structure or the geometry regarding the inlet slit 25, the outlet slit 27 and the recirculation passage 29 can be easily adjusted, the structure or the geometry being compatible with the optimal specifications regarding the compressor performance improvement.

In other words, the spaces are formed between the tip of the protrusion 21 as well as the protrusion 23 of the comb shape and the bottom of the corresponding concave part, one of the spaces and the other space being the inlet slit and the outlet slit; by adjusting the length or the width regarding the protrusions 21 and 23, the opening areas of the inlet slit 25 and the outlet slit 27 can be easily changed and the adjustment for the optimization of the recirculation flow rate can be easily performed.

Further, the recirculation passage 29 is not opened toward the air inlet side of the impeller 5. Thus, the noises are hard to be transmitted toward the upstream side; and, the level of the noise transmitted from the impeller side can be reduced without providing a noise insulation cover. And, the cost for reducing the noise level can be reduced.

(Second Mode)

Figure 5A:
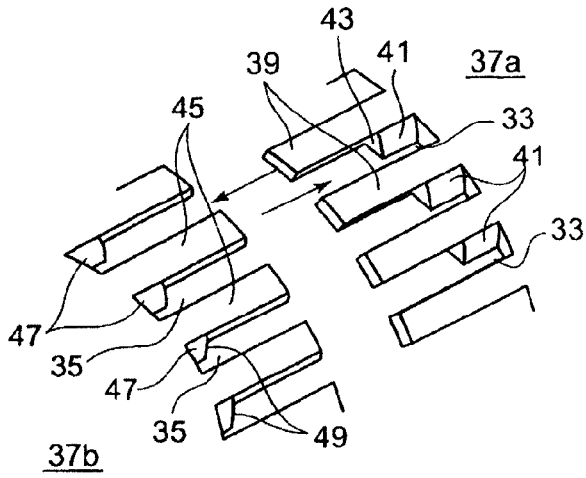
FIGS. 5(*a*), 5(*b*) and 5(*c*) explain a second mode of the present invention.
Figure 5B:
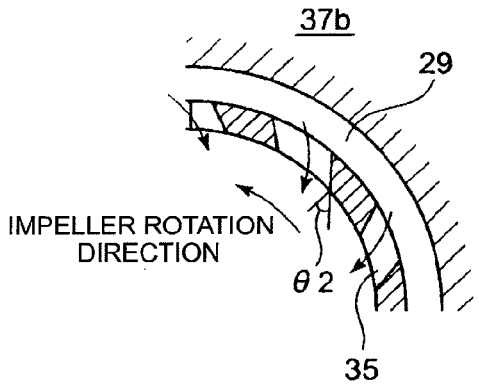
Figure 5C:
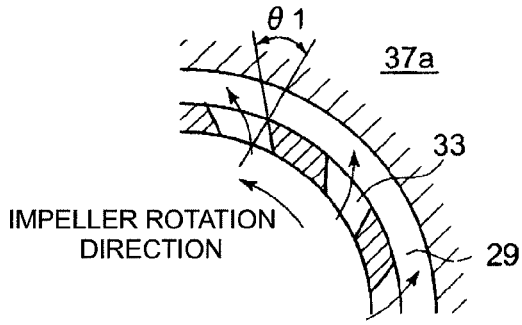

In the next place, based on FIGS. 5(*a*), 5(*b*), 5(*c*) and 6, the second mode of the present invention is now explained. Incidentally, the same components in the second mode as in the first mode are given common numerals; and, explanation repetitions are omitted.

In the first mode, the inlet slit 25 as well as the outlet slit 27 is directed along the radial direction regarding the rotation axis 7 as a center point; on the other hand, in this second mode, the inlet slit 33 is inclined along the same direction as the impeller rotation direction; the outlet slit 35 is inclined along the same direction as the impeller 5 rotation direction (so that the direction of the recirculation air flow streaming from the outlet slit 35 to the air inlet passage 11 is in the reverse direction of the impeller 5 rotation direction).

An inclination part 41 is formed on the bottom surface side regarding the comb shaped protrusion 39 provided at the first compressor housing member 37*a*, as well as, on a side wall of a protrusion 39 configuring the inlet slit 33. As shown in FIG.

5(*c*), the inclination direction is inclined along the same direction as the rotation direction of the impeller 5. The inclination angle 01 is, for instance, 20 to 30 degrees from the normal direction.

Further, the wall part 43 of the inclination part 41 is used as a place where the tip of a corresponding protrusion 45 provided on the second compressor housing member 37*b* comes in contact with the wall part 43, so that the relative mated-position of the first compressor housing member 37*a* and the second compressor housing member 37*b* is determined.

In this way, when the inlet slit 33 is inclined along the same direction as the rotation direction of the impeller 5, the swirl flow in the impeller can easily enter the inside of the recirculation passage 29. Hence, the recirculation flow rate can be increased, and the apparent air flow rate into the inlet slit 33 from the leading edge part of the impeller 5 is increased. Thus, the surging phenomenon can be effectively constrained.

Further, regarding the outlet slit 35, an inclination part 47 is formed on the bottom surface side regarding the comb shaped protrusion 45 provided at the second compressor housing member 37*b*, as well as, on a side wall of a protrusion 45 configuring the outlet slit 35. As shown in FIG. 5(*b*), the inclination direction is inclined along the reverse direction of the rotation direction of the impeller 5. The inclination angle 02 is, for instance, 20 to 30 degrees from the normal direction.

Further, the wall part 49 of the inclination part 47 is used as a place where the tip of a corresponding protrusion 39 provided on the first compressor housing member 37*a* comes in contact with the wall part 49, so that the relative mated-position of the first compressor housing member 37*a* and the second compressor housing member 37*b* is determined.

As described above, when the outlet slit 35 is inclined along the reverse direction of the impeller rotation direction, the direction of air flow into the inside of the impeller 5 changes from the X-arrow direction to the Y-arrow direction as shown in the illustrative flow drawing of FIG. 12. Thus, the air flow streams toward the impeller so as to effectively hit the impeller 5; and, the recirculation flow rate can be increased so that apparent air flow rate toward the impeller 5 can be further increased. Hence, the surging phenomenon can be effectively constrained.

According to the second mode, the inlet slit 33 is inclined along the same direction as the impeller rotation direction; the opening direction of the outlet slit 35 is inclined along the reverse direction of the impeller rotation direction. In this way, the flow rate of the recirculation air flow toward the leading edge of the impeller 5 through the recirculation passage 29 can be increased, and the surging phenomenon can be effectively constrained.

Moreover, the structure of the inlet slit 33 and the outlet slit 35 is formed so that the opening direction of the inlet slit 33 is inclined along the same direction as the impeller rotation direction and the opening direction of the outlet slit 35 is inclined along the reverse direction of the impeller rotation direction; the structure is formed in the manner that the inclination part 41 is provided on the side wall of the comb shaped protrusion 39 provided at the first compressor housing member 37*a* whereas the inclination part 47 is provided on the side wall of the comb shaped protrusion 45 provided at the second compressor housing member 37*b*. In this way, the structure of the inlet slit and the outlet slit is simply and surely formed; in addition, the optimal specification can be easily arranged by modifying the inclination angles.

(Third Mode)

Figure 7:
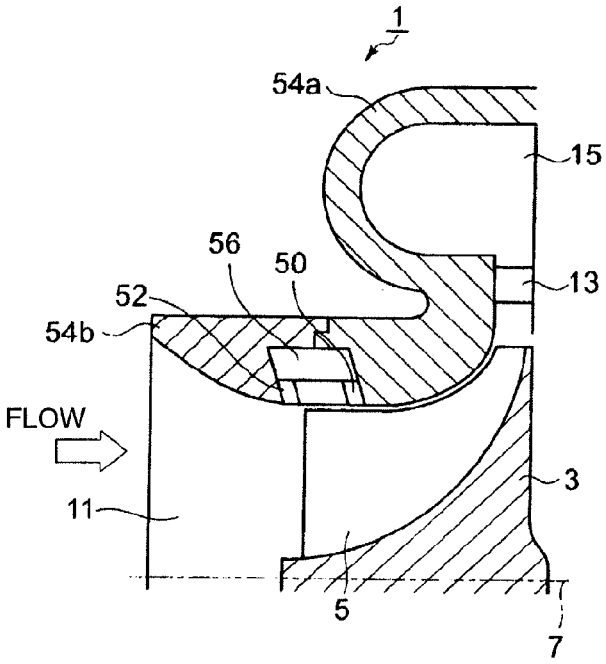
FIG. 7 explains a third mode of the present invention and corresponds to FIG. 1.

In the next place, based on FIG. 7, the third mode of the present invention is now explained. Incidentally, the same components in the third mode as in the other modes are given common numerals; and, explanation repetitions are omitted.

In the second mode, the inlet slit 33 as well as the outlet slit 35 is inclined along the impeller rotation direction; on the other hand, in this third mode, the inlet slit and the outlet slit are inclined along the direction of the rotation axis 7 of the impeller 5.

In this third mode, each of an inlet slit 50 and an outlet slit 52 is inclined along the direction of the rotation axis 7 so that the main air flow through the air passage is difficult to stream into the slit and the backward flow is easy to stream into the slit.

The inclination of the inlet slit 50 is formed by inclining the bottom surface of the comb shaped protrusion provided at a first compressor housing member 54*a*, as well as, by inclining the tip surface of the comb shaped protrusion provided at a second compressor housing member 54*b*; in a similar way, the inclination of the outlet slit 52 is formed by inclining the bottom surface of the comb shaped protrusion provided at the second compressor housing member 54*b*, as well as, by inclining the tip surface of the comb shaped protrusion provided at the first compressor housing member 54*a*. Further, as shown in FIG. 7, a recirculation passage 56 is also formed by the side wall surfaces that are inclined in response to the inclinations of the inlet slit 50 and the outlet slit 52.

As shown in FIG. 7, the inlet slit 50 that is inclined for the direction of the rotation axis 7 of the impeller 5 so that the main air flow through the air passage is difficult to stream into the inlet slit and the backward flow is easy to stream into the inlet slit; on the other hand, a backward flow toward the upstream side is apt to occur at the leading edge part (the inlet part) of the impeller under the low load operation condition in which the air flow rate is small; further, the backward flow is difficult to occur under a normal operation condition in which the air flow rate is normal; thus, the air recirculation is promoted only under the low load operation condition in which the air flow rate is small and the back flow toward the upstream side is apt to occur, whereas the air recirculation is constrained under the normal operation condition. In this way, under the normal operation condition, the air recirculation can be constrained and the performance deterioration can be prevented; and, under the low load operation condition, the air recirculation can be positively promoted and the occurrence of the surging can be prevented.

Further, as shown in FIG. 7, the outlet slit 52 is also inclined toward the leading edge of the impeller 05; thus, the recirculation air streams toward the inlet side of the impeller and an effective recirculation can be achieved.

Also in the third mode as is the case with the second mode, the optimal specification can be easily arranged by modifying the inclination angles of the tip end surface and the bottom surface regarding the comb shaped protrusions.

(Fourth Mode)

Figure 8:
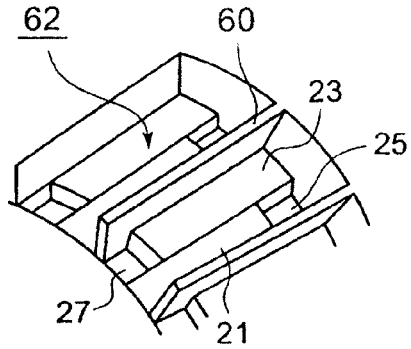
FIG. 8 shows a bird view according to a fourth mode of the present invention, and corresponds to FIG. 2.
Figure 9:
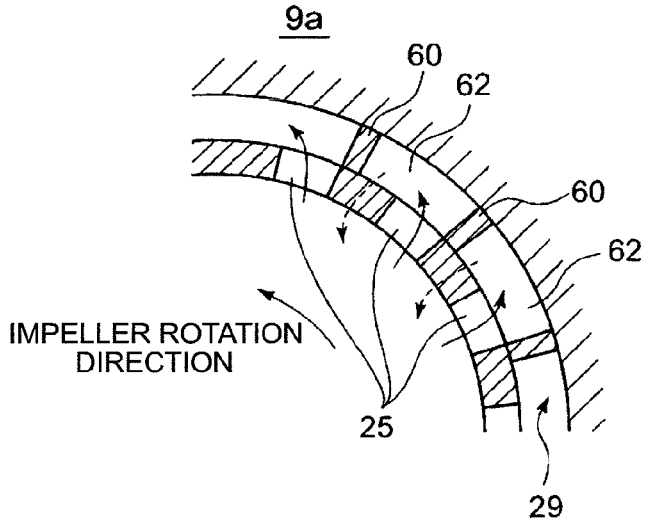
FIG. 9 explains the fourth mode, and corresponds to FIG. 3.

In the next place, based on FIGS. 8 and 9, the second mode of the present invention is now explained. Incidentally, the same components in the second mode as in the other modes are given common numerals; and, explanation repetitions are omitted.

In the fourth mode, at least one partition wall is set-up in the recirculation passage 29 so that the hoop direction space of a part of the recirculation passage or the whole of the recirculation passage 29 is partitioned into a plurality of area sections.

FIG. 8 shows a bird view regarding an enlargement of the part A in FIG. 1, FIG. 8 corresponding to FIG. 2. As shown in FIG. 8, a partition wall 60 and an adjacent partition wall 60 may divide the hoop direction space of a part of the recirculation passage 29 or the whole of the recirculation passage 29 into a plurality of area sections.

Further, as shown in FIG. 8, the partition wall 60 for partitioning the recirculation passage 29 in the hoop direction is set up along the direction of the rotation axis 7 of the impeller 5, on the outer periphery surface of the comb shaped protrusions 21 and 23, toward the outward side.

Figure 6:
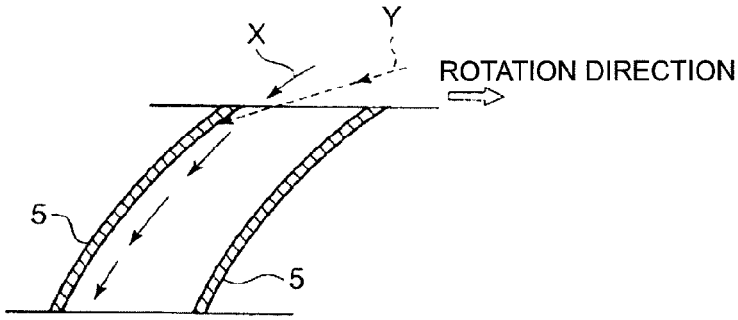
FIG. 6 explains the effect of the fluid flow from an outlet slit according to the second mode on the flow direction of the main fluid flow along an impeller blade.

According to the fourth mode, the velocity of the air flow into the recirculation passage 29 via the inlet slit 25 has a velocity component along the direction of the swirl flow in the impeller; in the area section 62 formed by the partition walls 60, the velocity component along the direction of the swirl flow is lost. Thus, when the air flow streams through the outlet slit 27, the velocity of the air flow does not include the velocity component along the direction of the swirl flow, and the air flow without the velocity component streams through the outlet slit streams into the main flow toward the leading edge part of the impeller 5 so as to effectively hit the impeller 5 and increase the collision load of the air flow on the impeller. Further, the pressure of the air at the suction opening around the leading edge of the impeller increases so that the air flow rate of the recirculation flow can be increased. As is the case with the explanation of the second mode based on FIG. 6, the smaller the velocity component along the rotation direction of the impeller 5, and the greater the recirculation air flow rate.

Further, the air flow whose velocity component along the rotation direction is lost in the area sections 62 formed by the partition walls 60 is easily apt to form an air flow along the inclination of the outlet slit 27; thus, the airflow whose flow direction is reverse against the rotation direction of the impeller 5 can be easily formed. In this way, the effect of the outlet slit 27 from which the air flow streams in the reverse direction of the rotation of the impeller 5 can be effectively achieved, as is the case with the effect of the outlet slit in the second mode as explained based on FIG. 6.

Further, the set-up angle regarding the partition wall 60 may be directed along the radial direction regarding the rotation axis 7 as a center point; the set-up angle may be also directed along the inclination direction of the inlet slit 33 or the outlet slit 35 in the second mode. When the set-up angle is directed along the inclination direction of the inlet slit 33 or the outlet slit 35 in the second mode, the air flow rate into or out of the recirculation passage 29 is effectively increased.

(Fifth Mode)

Figure 10A:
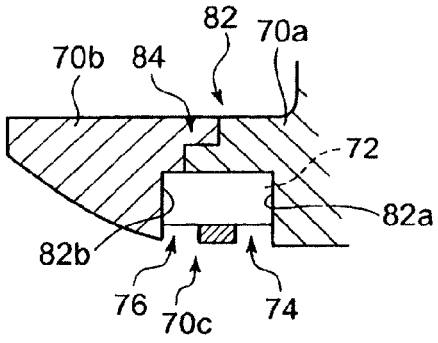
FIGS. 10(*a*) and 10(*b*) explain a fifth mode of the present invention.
Figure 10B:
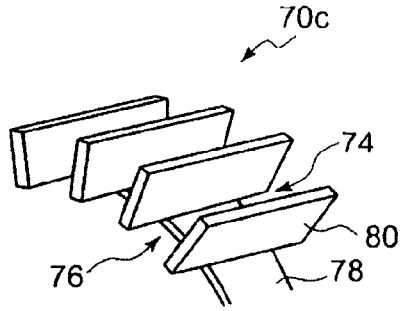

In the next place, based on FIGS. 10(*a*) and 10(*b*), the fifth mode of the present invention is now explained. Incidentally, the same components in the fifth mode as in the other modes are given common numerals; and, explanation repetitions are omitted.

In the fifth mode as well as the following sixth mode, between the first compressor housing member 70*a* and the second compressor housing member 70*b*, a third compressor housing member (an intermediate compressor housing) 70*c* of an annular shape is attached; the inner periphery surface side of the third compressor housing member 70*c* faces the air passage on the outer periphery part side of the impeller; on the outer periphery surface side of the third compressor housing member 70*c*, a recirculation passage 72 is formed; and, an inlet slit 74 is formed on an end side of the third compressor housing member 70*c*, and an outlet slit 76 is formed on another end side of the third compressor housing member 70*c*.

As shown in FIG. 10(*b*), the third compressor housing member 70*c* includes, but not limited to: a body 78 of an annular shape, and a plurality of plate members 80 that are protruded from and fixed to the outer periphery surface of the body 78 at evenly spaced intervals, side by side along the hoop direction. The plate member 80 is fit into and fixed to the space that is formed by a mating surface 82*a* on the side of a first compressor housing member 70*a*, a mating surface 82*b* on the side of a second compressor housing member 70*b*, and the inner periphery surface of a fitting structure 84 provided at a mating surface 82 between the first compressor housing member 70*a* and the second housing member 70*b*.

Further, a recirculation passage 72 is formed between the outer peripheral surface of the body 78 of an annular shape and the inner periphery surface of the fitting structure 84; and, the plate members 80 form the partition walls that divide the recirculation passage 72 side by side in the hoop direction.

As described above, the third compressor housing member 70*c* is fit into the space formed by inner periphery surface of a fitting structure 84, the mating surface 82*a* on the side of the first compressor housing member 70*a*, and the mating surface 82*b* on the side of the second compressor housing member 70*b*. The inlet slit 74 is formed on an end side of the body 78 that configures the third compressor housing member 70*c*, whereas the outlet slit 76 is formed on another end side of the body 78. Hence, the opening area regarding the inlet slit 74 as well as the outlet slit 76 can be set freely at a larger area level in comparison with such a case of the first mode where the opening area of the slit is formed by mating the comb shaped protrusions. Accordingly, the recirculation flow rate can be increased.

Further, in relation to the modification of the opening area regarding the inlet slit 74 and the outlet slit 76 as well as the modification of the opening direction, in order to achieve an optimal specification for suitably enhancing the compressor performance, the configuration and the geometry regarding the inlet slit, the outlet slit and the recirculation passage can be easily adjusted by arranging the inclination of the wall surface on each end side of the body 78 configuring the third compressor housing member 70*c* as well as by inclining the fitting angle regarding the plate member 80.

(Sixth Mode)

Figure 11:
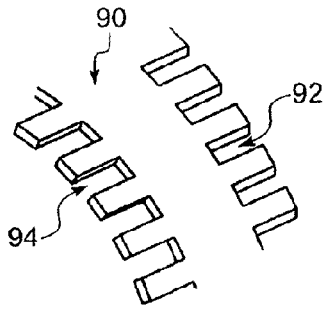
FIG. 11 explains a sixth mode of the present invention, and corresponds to FIG. 10(*b*)

In the next place, based on FIG. 11, the sixth mode of the present invention is now explained. Incidentally, the same components in the sixth mode as in the other modes are given common numerals; and, explanation repetitions are omitted.

This sixth mode is a modification example regarding the third compressor housing member 70*c*; and, the third compressor housing member 70*c* includes only a simple body 90 of an annular shape without being provided with the plate members for partitioning the recirculation passage.

An inlet slit 92 is formed at an end side of the body 90 along the hoop direction, whereas an outlet slit 94 is formed at another end side of the body 90 along the hoop direction.

With the configuration as described above, a recirculation passage is formed on the outer periphery surface side of the body 90; an opening of an inlet slit 92 can be formed on an end side of the body whereas an opening of an outlet slit 94 can be formed on another end side of the body. Accordingly, the inlet slit 92, the outlet slit 94 and the recirculation passage can be compactly formed, and the compressor housing provided with the recirculation passage can be compact and light-weight.

INDUSTRIAL APPLICABILITY

The present invention can provide a compressor of an exhaust gas turbocharger wherein the structure of the inlet slit, the outlet slit and the recirculation passage can be adjustably arranged at the same time when the compressor housing of a divided type is assembled or disassembled;

the man-hours needed for assembling the compressor as well as the production cost can be reduced;

the structure of the inlet slit, the outlet slit and the recirculation passage can be compact;

the structure regarding the inlet slit, the outlet slit and the recirculation passage can be easily adjusted or modified, the structure being suitable for the improvement of the compressor performance; and, the noises generated in the impeller can be reduced without providing a noise insulation cover.

Thus, the present invention is suitable for being used in the compressor of an exhaust gas turbocharger.

The invention claimed is:

1. A compressor of an exhaust gas turbocharger, comprising:

a recirculation passage connecting an inlet slit which is opened toward an air passage on a casing of an impeller to an outlet slit that is opened toward an inlet air passage formed in the casing, wherein a part of an air flow through the impeller is taken in the recirculation passage through the inlet slit, and the air taken in the recirculation passage flows toward the inlet air passage, wherein a mating surface of the compressor housing which is divided into compressor housing members in a direction of a rotation axis of the impeller is formed in the neighborhood of an inlet part of the impeller;

a space forming the recirculation passage, the inlet slit and the outlet slit are formed between the mating compressor housing members, the mating surface includes comb shaped mating surfaces respectively formed on one of the compressor housing members and the other one of the compressor housing members, and a convex part of one of the comb shaped mating surfaces, formed by a tooth of the comb shaped mating surfaces of the one of the compressor housing members, is fit into a concave part of the other comb shaped mating surface, formed between adjacent teeth of the comb shaped mating surfaces of the other one of the compressor housing members so that a space formed between a tip part of the convex part and a bottom part of the concave part forms the inlet slit and the outlet slit.

2. The compressor of the exhaust gas turbocharger according to claim 1, wherein a side wall of the convex part of the comb shaped mating surface is inclined along the same direction as the rotation direction of the impeller, the side wall forming the inlet slit.

3. The compressor of the exhaust gas turbocharger according to claim 1, wherein a side wall of the convex part of the comb shaped mating surface is inclined along the reverse direction of the rotation direction of the impeller, the side wall forming the outlet slit.

4. The compressor of the exhaust gas turbocharger according to claim 1, wherein the tip part and the bottom part which form the inlet slit are inclined along the direction of the rotation axis of the impeller to deter a main flow through the air passage to flow into the inlet slit and enhance a backward flow to stream into the inlet slit.

5. The compressor of the exhaust gas turbocharger according to claim 1, wherein partition walls dividing the recirculation passage in a circumferential direction are set up along the rotation axis direction of the impeller outside of an outer periphery of the convex part and the concave part of the comb shaped mating surface; and the partition walls form an area section provided with the inlet slit and the outlet slit.

* * * * *